United States Patent [19]

O'Brien et al.

[11] 4,055,131

[45] Oct. 25, 1977

[54] ELECTRONIC CONTROL ARRANGEMENT FOR SEWING MACHINES

[75] Inventors: James Eugene O'Brien, Kenilworth; Edward Walter Ostapczuk, Union, both of N.J.

[73] Assignee: The Singer Company, New York, N.Y.

[21] Appl. No.: 670,777

[22] Filed: Mar. 26, 1976

[51] Int. Cl.[2] ..... D05B 3/02

[52] U.S. Cl. ..... 112/158 E; 112/258

[58] Field of Search ..... 112/158 E, 121.11, 121.12, 112/219 A, 258; 318/567, 569; 66/154 A, 74 A, 50 R

[56] References Cited

U.S. PATENT DOCUMENTS

| | | | |
|---|---|---|---|
| 3,400,677 | 9/1968 | Bowers et al. | 112/219 A |
| 3,977,338 | 8/1976 | Wurst et al. | 112/158 E X |
| 3,982,491 | 9/1976 | Herzer et al. | 112/121.12 |

*Primary Examiner*—Thomas F. Callaghan
*Assistant Examiner*—Peter Nerbun
*Attorney, Agent, or Firm*—Edward L. Bell; Robert E. Smith; Edward P. Schmidt

[57] ABSTRACT

An electronic control arrangement for a sewing machine with a frame having access openings at the top and bottom thereof and supporting therein functional mechanical and electromechanical and electrical sewing machine components. The electronic control arrangement includes a control panel disposed over a portion of the top access opening and interconnected with printed circuit boards having electronic components thereon for regulation of the electromechanical sewing machine components, the entire arrangement being organized to be removable as a whole for replacement or substitution from the top access opening. Means are provided accessible from the bottom access opening to removably support the control arrangement at the bottom thereof and provide a heat sink therefor.

3 Claims, 7 Drawing Figures

ELECTRONIC CONTROL ARRANGEMENT FOR SEWING MACHINES

BACKGROUND OF THE INVENTION

Presently in electronically controlled sewing machines, the electronic components are carried on a plurality of circuit boards supported in the sewing machine frame in specific relation to mechanical or electromechanical components from which they derive information or to which they supply information in the form of electrical signals. Thus, a circuit board which may support a solid state memory and pulse generating components to signal the release of information from the solid state memory, would be located adjacent a cam device for initiating pulses supported on the horizontal armshaft of the sewing machine. The power amplifiers and heat sink for the power transistors of the power amplifiers may be carried on a second board in a position where a heat sink for the power transistors may be firmly attached to the sewing machine frame, thereby used as an additional heat sink. Additional circuit boards are required to carry components in a location accessible to a sewing machine operator for selective variation of the sewing parameters or function.

However, appearance design of present day household sewing machines favors a clean, uncluttered look, best and most economically achieved by having a sewing machine frame with as few openings as possible, particularly in the front facing a machine operator. Access to the frame interior for placement of the functional components normally requires at a minimum an opening in the top for placement of needle bar lateral drive components, in the head end for installation of the needle bar and presser bar arrangements, and in the bottom for location of feed components. Such a design requires considerable resourcefulness in placement of electronic, mechanical and electromechanical components in view of the limited access to the interior of the frame, which is normally not compatible with mass production of a sewing machine.

Lastly, favored Engineering design of sewing machines requires separation of function and control whereby a sewing machine may be assembled with all, or almost all, of the required functional components prior to addition of, or interchange of, a control package assembly which may be modified, or added to, to reflect the latest marketing considerations.

What is required is an electronic control arrangement for a sewing machine which may be readily inserted or removed from access openings in the top or bottom of the frame thereof for interaction with and regulation of functional mechanical and electromechanical and electrical components supported within the frame.

SUMMARY OF THE INVENTION

The above requirement is achieved in an arrangement wherein a control panel is disposed over a portion of the top access opening and is connected by brackets to a substantially vertically disposed control circuit board supporting electronic components responsive to instructions from the control panel for regulation of the electromechanical components. A power supply and pulse generator circuit board is supported on a support member affixed to the control circuit board and on a brace affixed to the support member at the upper end of the control circuit board opposite the control panel, in a position to cooperate with a pulse generating cam affixed to the sewing machine horizontal armshaft in the generation of pulses to synchronize the regulation of the electromechanical and electrical components by the control circuit board. The brace and a strut attached to the control board opposite the control panel are both fastened to the sewing machine frame and comprise the upper support for the Electronic Control Arrangement. A heat sink arrangement fastened to the bed of the sewing machine within the arm standard supports the lower extremity of the electronic control package in a fashion releasable from the bottom access opening of the sewing machine frame. Thus, after the electromechanical and electrical components of the sewing machine are disconnected from terminals of the electronic control arrangement, and the removal of the two screws through the top access opening and release of the heat sink arrangement via the bottom access opening the entire electronic control arrangement of the sewing machine may be removed.

DESCRIPTION OF THE DRAWINGS

With the above and additional objects and advantages in view as will hereinafter appear, this invention comprises the devices, combinations and arrangement of parts hereinafter described and illustrated in the accompanying drawings of a preferred embodiment in which.

Figure 1:
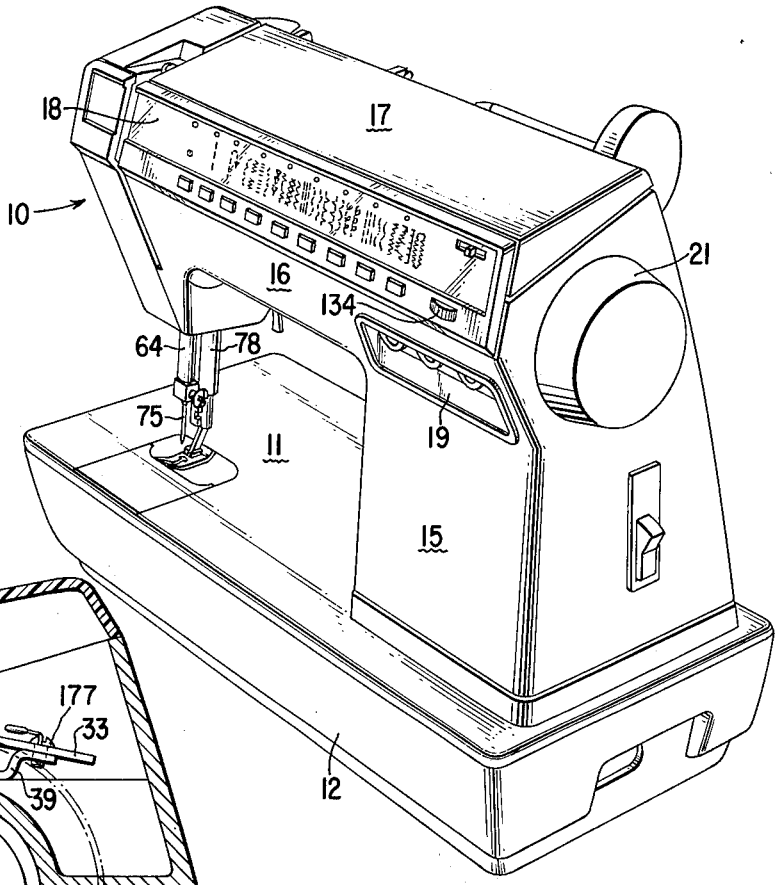
FIG. 1 is a perspective of a sewing machine in which the invention may be incorporated.

Referring in FIG. 1 there is shown a sewing machine 10 having a bed 11 supporting a standard 15 from which extends a bracket arm 16 overhanging the bed. The bed 11 is cast with an open bottom normally enclosed by bed cover 12 for appearance sake. Similarly, the bracket arm 16 is cast with an open top normally covered by a top cover 17 and control panel 18. An auxiliary panel 19 covers an additional small opening in the front of the standard through which project controls for operator variation of sewing parameters. Thus, it is apparent that the assembly of the sewing machine 10 is accomplished almost exclusively by access from the top or bottom thereof prior to installation of the top cover 17, control panel 18 and bed cover 12.

Figure 2:
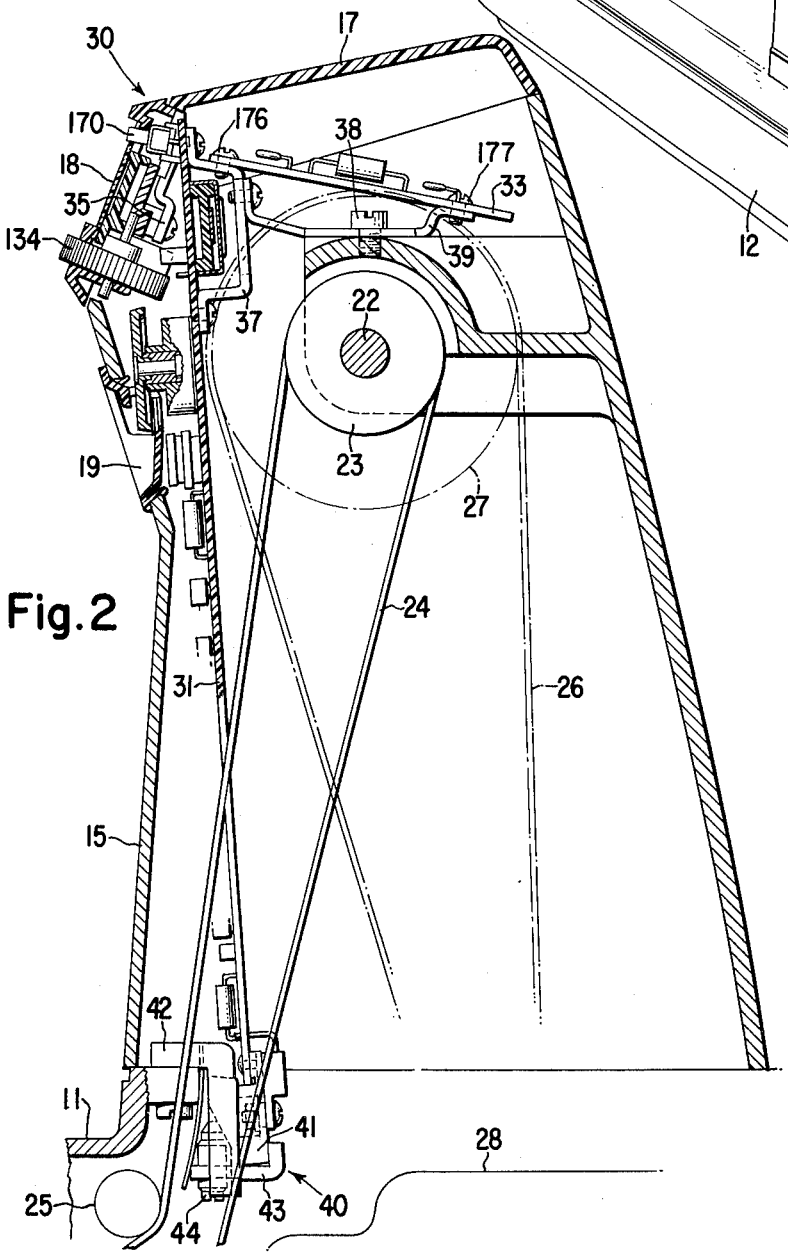
FIG. 2 is a cross section of the sewing machine of FIG. 1 taken through the arm standard.

FIG. 2 is a cross section of the sewing machine shown in FIG. 1 taken through the standard 15 thereof without many of the functional components shown for the sake of simplicity. In this view some of the mechanical components of the sewing machine 10 are visible including the horizontal armshaft 22 and drive pulley 23 connected by belt 24 to sewing instrumentalities and a feed system in the bed of the sewing machine. An idler pulley 25 is shown which permits the belt to be directed forwardly in the bed 11. Also shown in phantom is a drive belt 26 on main drive pulley 27 connecting the armshaft 22 to a drive motor (not shown).

More importantly, in FIG. 2 is seen an electronic control arrangement 30 consisting of the control panel 18, printed circuit board 31 supporting the control circuitry thereon (not shown for simplicity), printed circuit board 33 supporting primarily power supply circuitry and pulse generating circuitry (also not shown for simplicity); and brackets 35 supporting the control panel attached to the control board 31 support 37 for the power supply board 33 attached to the control board 31, and brace 39 attached to support 37 and the power supply board 33 and providing attachment to the standard 15 by means of screw 38. At the lower extremity of the control circuit board 31 is shown a heat sink arrangement 40 which provides additional support for the electronic control package 30. The heat sink arrangement comprises a heat sink member 41 affixed by suitable means to the lower extremity of the control circuit board 31. The heat sink member 41 lies contiguous a heat conducting bracket 42 firmly connected to the sewing machine bed 11 for good thermal conductivity thereto. A clamp member 43, supported by the bracket 42, carries a cone point screw 44 which cooperates with an inclined surface on the bracket when the screw is advanced to draw the heat sink member 41 and the bracket 42 into intimate heat conducting contact. The cone point screw 44 is accessible from the open bottom of the bed 11 when the bed cover 12 is removed.

Figure 3:
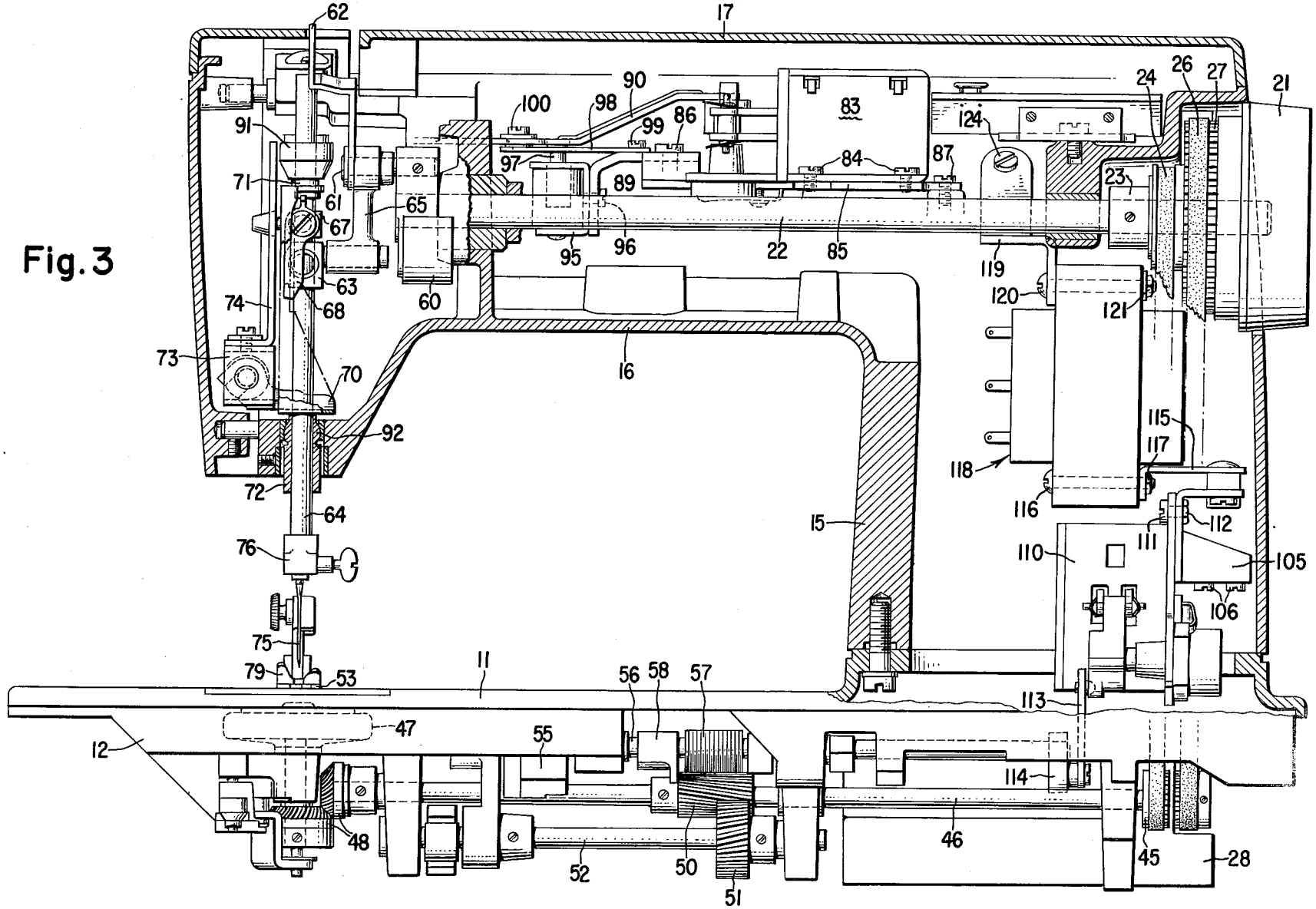
FIG. 3 is an elevational view of the sewing machine of FIG. 1 partially in section to show the location of some of the functional components thereof.

FIG. 3 is an elevation of the sewing machine shown in FIG. 1 partially in section to disclose some of the main functional components therof which are to be assembled into the sewing machine frame prior to installation of the electronic control arrangement 30. There is visible the horizontal armshaft 22, connected to a hand wheel 21, which supports the main drive pulley 27 and main drive belt 26 connected to the motor 28. Also visible is the feed and hook drive pulley 23 connected by belt 24 to a hook shaft pulley 45 supported on a hook shaft 46 in the bed 11 of the sewing machine 10. Connection to the hook 47 is effected by a pair of miter gears 48. As is well known to those in the art, the hook 47 revolves at twice the speed of the horizontal armshaft 22 to enable loop cast off to occur prior to the beginning of the next stitching cycle. Thus a helical gear 50 supported on the hook shaft 46 as in mesh with a helical gear 51 supported on a feed shaft 52 in a ratio of 1:2 to provide for feed advance between each stitch. The feed system utilized is a conventional four motion feed system imparting up and down, feed advance and return motion to a feed dog 53. Feed regulation is achieved by varying the angular position of a feed regulator 55 supported on a feed regulator shaft 56. A torsion spring 57 biased against the bed 11 and a lever 58 affixed to the shaft 56 continually urges the feed regulator 55 to a forward feed position.

At the extremity of the bracket arm 16, the horizontal armshaft 22 supports a crank 60 having a stud 61 attached thereto which actuates a take up lever 62 and reciprocates a drive link 63 on a needle bar 64 via a connecting link 65. The drive link 63 reciprocates freely on the needle bar 64, with connection to the needle bar for endwise reciprocation thereof being effected by means of needle bar block 67 attached to the needle bar which carries a latch 68 clasping the drive link to the needle bar block. A lever 70 shown partially in phantom and supported on needle bar bushings 71, 72, may be rotated under the influence of solenoid 73 supported on bracket 74 affixed to the bracket arm 16 to separate the latch 68 from the drive link 63, thereby to permit the drive link to reciprocate freely on the needle bar 64 resulting in skipped stitches. When the drive link 63 is clasped to the needle bar block 67 by the latch 68, a sewing needle 75, affixed to the end of the needle bar 64 by needle clamp 76, will cooperate with the hook 47 in the sewing bed 11 in the formation of stitches. Also supported in the extremity of the bracket arm 16 behind the needle bar 64 is a presser bar 78 (see FIG. 1) having at the extremity thereof presser foot 79, all urged by a presser mechanism (not shown) into pressure contact with feed dog 53.

Figure 4:
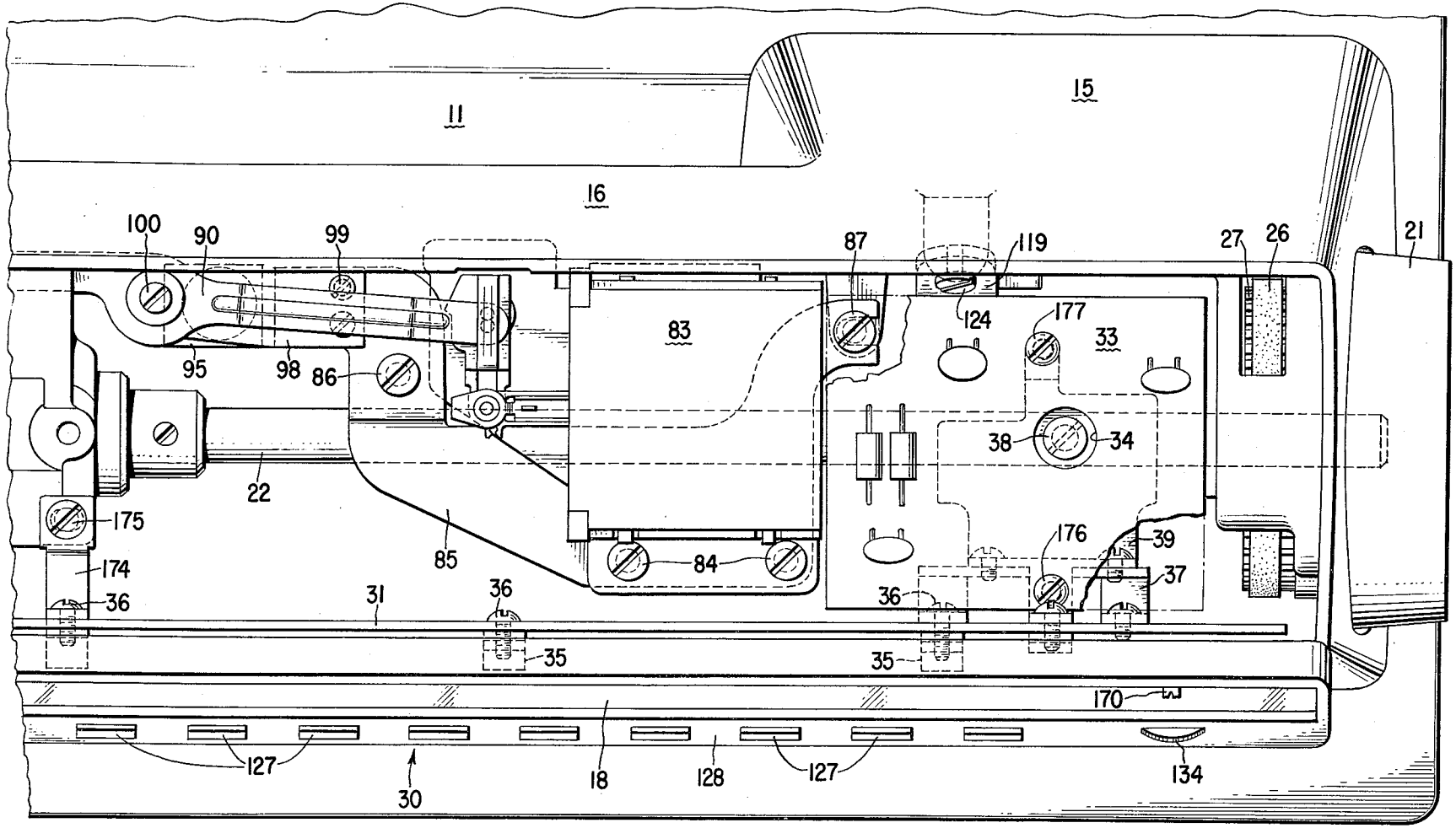
FIG. 4 is a partial top plan view of the sewing machine of FIG. 1 with the top cover removed.

Within the bracket arm 16 is a linear motor 83 attached by screws 84 to a bracket 85 which is adjustably connected to the bracket arm by screws 86, 87 (see FIG. 4). The linear motor 83 is connected by a driving arm 90 to a needle bar gate 91 pivoted in the bracket arm 16. The upper needle bar bushing 71 supported in the needle bar gate 91 and the lower needle bar bushing 72 supported in bracket arm 16 are fashioned with outer spherical bearing surface 92 which permit the needle 75 to transverse an arc as that part of the needle bar gate 91 supporting the upper needle bar bushing 72 traverses an arc under the influence of the linear motor 83 through the driving arm 90. An extension 89 to the bracket 85 supports a solenoid 95 fixed thereto by screw 96, the armature 97 of which is connected to a leaf spring 98, also affixed to the bracket 85 by screw 99. The leaf spring 98 has an opening therein (not shown) which cooperates with a screw 100 affixed to the driving arm 90 and extending therethrough to prevent lateral motion of the needle 75 when the solenoid 95 is not activated. The solenoid 95 isthus used as a safety device when the sewing is operated in the straight stitch mode.

A bracket 105 affixed to the standard 15 by screws 106 supports a linear motor 110 attached to the bracket by screws 111 and nuts 112. The linear motor 110 is connected by link 113 to lever 114 affixed to the feed regulator shaft 56, thereby to adjust the angular position of the feed regulator 55 for control of feed rate and direction. Bracket 105 also supports a brace 115 fastened to the laminations of a low voltage power transformer 118 by screws 116 and nuts 117. A hanger 119 attached to the laminations of the low voltage power transformer 118 by screws 120 and nuts 121 is affixed to the standard 15 by screw 124 and is the upper support for the low voltage transformer in the standard. The low voltage transformer 118 converts line voltage to low voltage for the power supply circuit board 33 as well as for other electrical components of the sewing machine 10.

Thus far has been described a sewing machine frame comprising a bed 11, standard 15 and bracket arm 16 containing the main sewing machine functional components including the sewing instrumentalities and drive therefor, a feed system, basting stitch mechanism, linear actuators for needle bar lateral motion and feed regulation, a straight stitch safety device, and a low voltage power transformer for providing low voltage alternating current to a power supply and other electrical components. The functional components disclosed are not the only components required or desirable, but are merely indicative of the type of functional component which may be preassembled into the sewing machine frame prior to insertion of an electronic control arrangement 30. Not shown in FIG. 3, in order to simplify this figure to enable better comprehension, are the leads from the various electrical and electromechanical components which are ideally brought to the top of the bracket arm 16 for ready connection to, or disconnection from, terminals on the control circuit board 31 or power supply circuit board 33. Also not shown is a cam device carried on the horizontal armshaft 22 in front of the hanger 119 for the low voltage power transformer 118, which cooperates with electronic components including a Hall effect device part of the electronic control arrangement 30 to initiate control pulses required for the synchronized operation of the functional components. Many other necessary connections or functional components will suggest themselves to those skilled in the art which have not been shown to avoid the complexity of details not necessary to an explanation of the invention.

Figure 5:
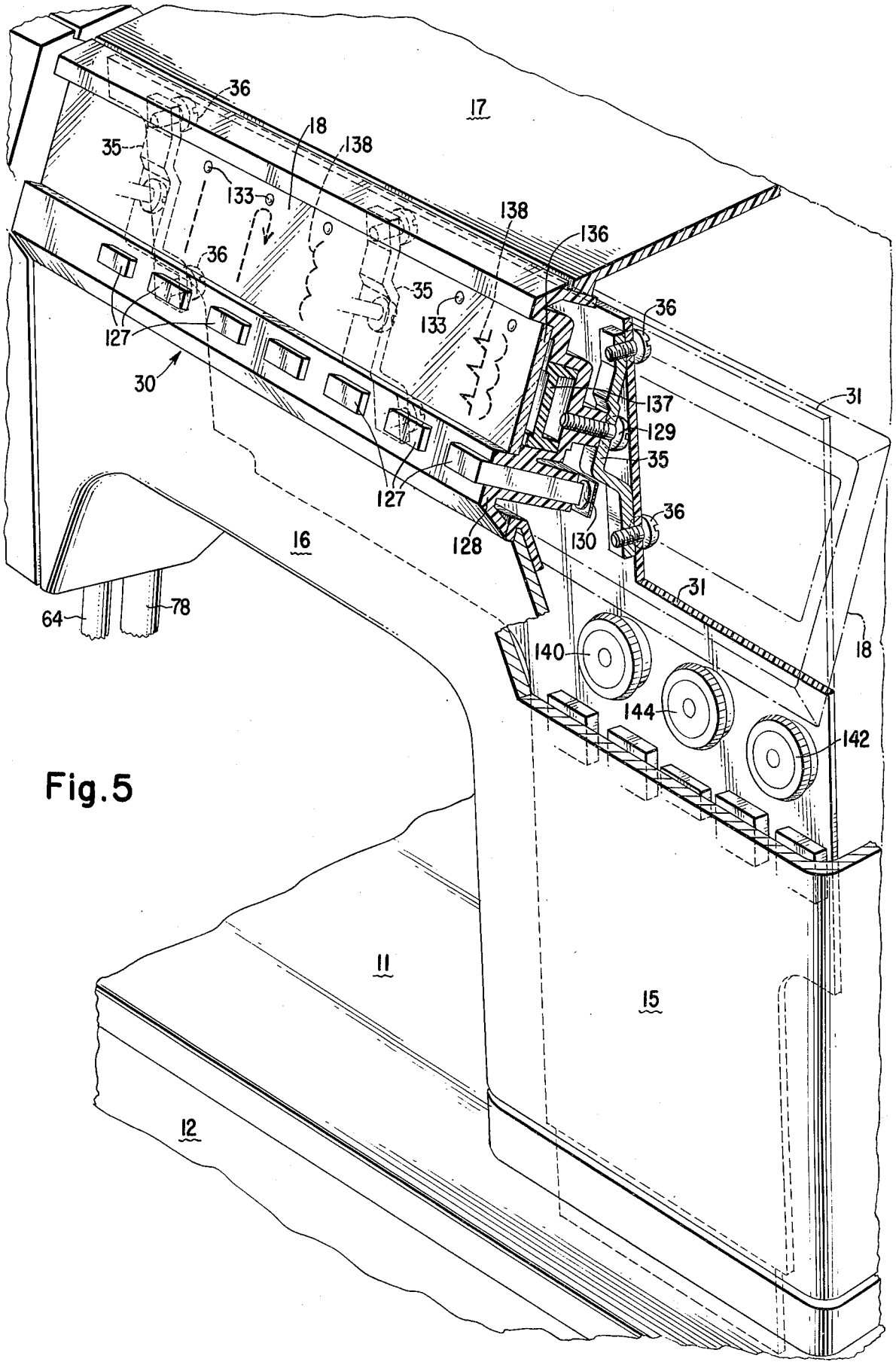
FIG. 5 is a perspective view of a part of the sewing machine of FIG. 1, partially in section to show details of the connection of the control circuit board to the control panel.

In FIG. 5 is shown in greater detail the connection of the control panel 18 to the control circuit board 31. A greater understanding of the operation of the control panel 18 may be had by reference to the United States Patent No. 3,913,506, issued on October 21, 1975 to the same assignee as the instant application, which is hereby incorporated by reference and made a part of this application. Thus a push botton 127 carried in an escutcheon member 128 may be depressed to engage a switch 130 in switch pack 131 (see also FIG. 6) supported on control circuit board 31, for selection of a group of patterns (see FIG. 1). Selection of a particular group is indicated by a light emitting diode (LED) 133, there being an LED for each switch 130 in the switch pack 131. Selection of a particular pattern in a group is effected by rotation of dial 134 (see FIG. 1) which manipulates a switch to select a particular member of any group. In FIG. 5 the escutcheon member 128 carries a transparent cover plate 136 through which LED's 133 may be seen and indicia 138 on a display panel 137 slidable between the escutcheon member and the transparent cover plate under the influence of the dial 134. Provision may be made on the transparent cover plate 136 to indicate the particular pattern selected within the group indicated by LED 133 by the manipulation of the dial 134.

The control panel 18 is supported on four brackets 35, one of which is shown in FIG. 2. In FIG. 5 one of the brackets 35 is shown in section, from which it is clear that the brackets are retained to the control circuit board 31 by screws 36. Screws 129 pass through the brackets 35 and into the escutcheon member 128 thereby to retain the control panel 18 firmly attached to the brackets and the control circuit board 31. Also visible in FIG. 5 are the operator controls, supported on control circuit board 31, for varying sewing parameters, which extend through the auxiliary panel 19. Thus dial 140 controls the maximum lateral motion or bight of the needle bar 64 and needle 75, dial 142 adjusts the feed rate of the feeding system, and dial 144 adjusts the feed balance or the relative ratio of reverse feed to forward feed for pattern sewing and buttonholes.

Figure 6:
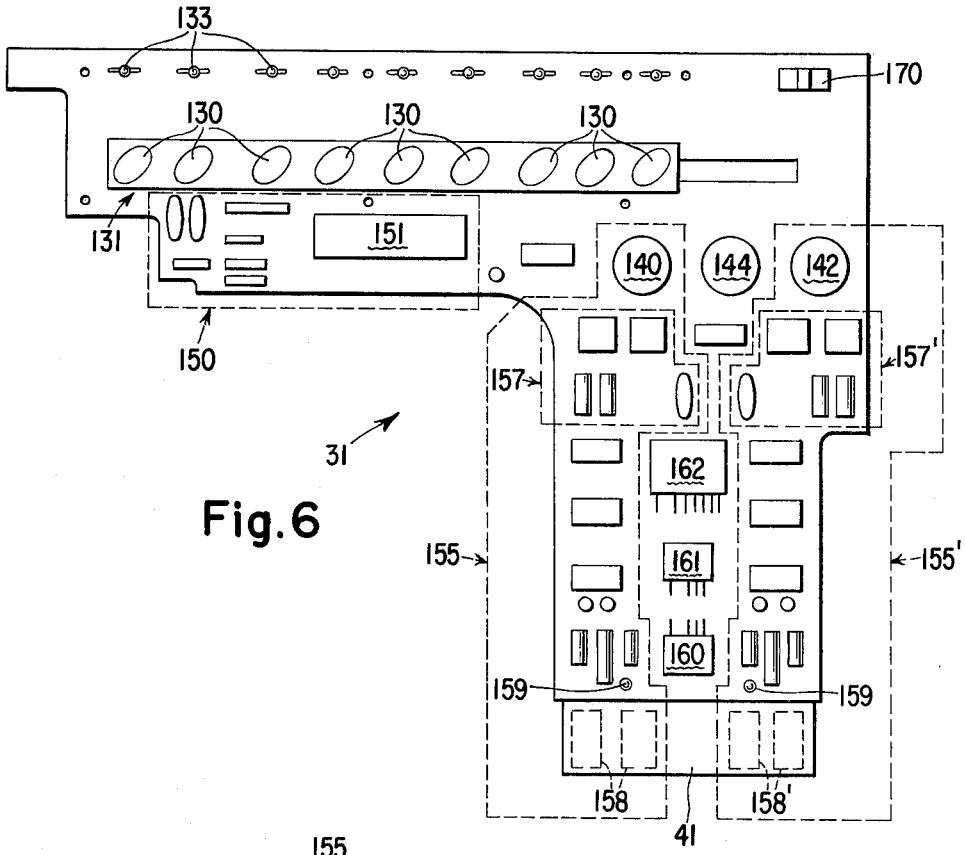
FIG. 6 is an elevation of the control circuit board.

In FIG. 6, the arrangement of the various electronic components on the control circuit board 31 is indicated. The logic area 150 including the Large Scale Integration integrated circuit (LSI) 151 solid state memory is responsive to operator instructions from depression of a push button 127 and rotation of dials 134, 140, 142 and 144. The particular push button 127 and switch 130 depressed is indicated by the corresponding LED 133 activated. Under the influence of pulse generating components supported on the power supply and pulse generating circuit board 33, information in digital form is released from the LSI 151 at the proper time in a stitch cycle and transferred to Digital to Analog Converters (D/A). Two parallel channels are provided, i.e. a bight channel 155 for lateral needle position, and a feed channel 155' for regulating feed. Within the bight channel 155 there is provided a D/A Converter 157 for converting the bight digital information from the LSI 151 to analog form usable by the linear motor 83. There is also provided a control function implemented by dial 140 for limiting the lateral motion of the needle 75 at the operator's discretion. The remainder of the bight channel 155 is devoted to servoamplifier including feedback and rate control circuits to control overshoot of the bight linear motor 83. The servoamplifier terminates in power transistors 158 suitably supported on heat sink member 41 attached to the lower extremity of control circuit board 31 by rivets 159. Connection of the bight linear motor 83 to the control circuit board 31 is made through bight motor plug 160. The feed channel 155' provides components corresponding to the bight channel with the numbers primed except for operator control function provided for by dial 142 as was previously explained. The necessary power for the control circuit board 31 is provided through power plug 162, connecting the control circuit board to the power supply board 33.

Figure 7:
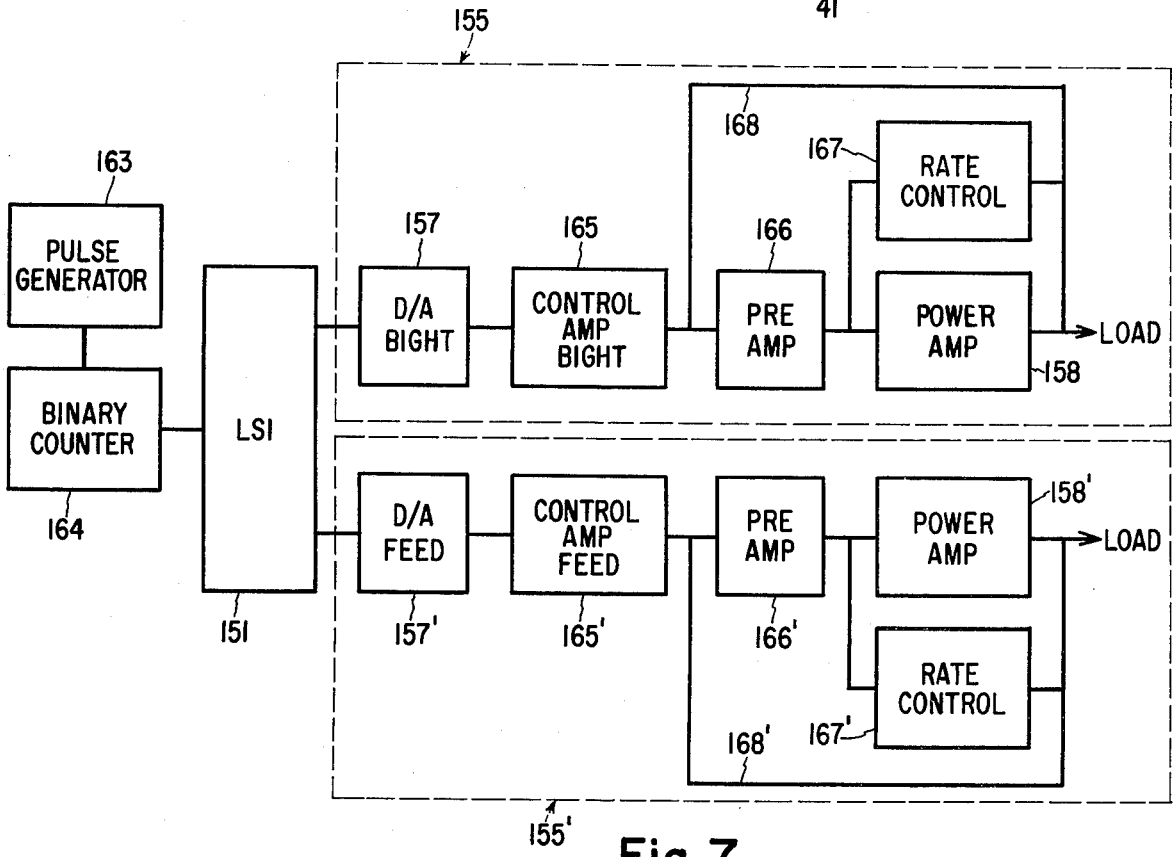
FIG. 7 is a simplified block diagram of the electronic control arrangement.

FIG. 7 is a simplified block diagram for the operation of the main functional components controlled by the control circuit board 31. Not included in the block diagram is a pattern selection arrangement which is more completely disclosed and described in the aforementioned U.S. Pat. No. 3,193,506 incorporated by reference herein to which reference may be had. Thus in the simplified block diagram a pulse generator 163 is responsive to each revolution of the horizontal armshaft 22 by means of a cam (not shown) mounted thereon to output a pulse to a binary counter 164 which is used as an address counter for the LSI 151. The signal pulses are counted up in the binary counter 164 to provide a time series of progressively increasing binary numbers corresponding to the progressively increasing number of stitches in the pattern, since each revolution of the horizontal armshaft 22 results in a needle penetration of the work fabric. The output from the binary counter 164 to the LSI causes the LSI to output positional information in digital form related to the positional coordinates for each stitch of a predetermined pattern. The output from the LSI may include digital data for needle position and digital data for feed rate. The digital data for needle position is converted to analog information in digital to analog converter 157. The D/A converter 157 outputs the analog signal to a control amplifier 165 which may be operator adjusted vial dial 140 to regulate sewing machine bight. The regulated signal then is amplified in a bight servoamplifier including preamplifier 166, power amplifier 158, with a feedback loop 168 indicative of present position of the sewing needle 75, and rate control 167 sensitive to the present and proposed position of the sewing needle to prevent overshoot of the proposed position. The load for the bight servoamplifier is the bight linear motor 83. The digital data for feed rate is processed in the same way, the components therefor having the same numbers primed.

The LSI 151 may also be utilized for other functional control. For example the switch 170 on control circuit board 31 may be utilized with the LSI 151 to limit bight when a twin needle is substituted for the single sewing needle 75 to prevent harpooning of a zigzag throat plate 13. Similarly, if a straight stitch throat plate is utilized, the LSI 151 may activate the solenoid 95 to prevent sewing at other than center needle position. The LSI 151 may also be programmed to activate the solenoid 73 to provide for skipping of stitches as desired. Many other uses for the LSI 151, alone or in conjunction with other electrical or electronic components will suggest themselves to those skilled in the art which may be incorporated in a sewing machine having an electronic control arrangement 30.

Thus far has been described an electronic control arrangement 30 for a sewing machine 10 supporting functional components therein, the sewing machine having access thereto from the top and bottom only. The electronic control arrangement 30 comprises a control panel 18 attached to a control circuit board 31 to which is also attached a power supply circuit board 33. Referring to FIG. 2 and 4 it is apparent that the electronic control arrangement 30 has brace 39 thereof attached to the standard 15 of the sewing machine 10 by screw 38, which may be accessible after removal of the top cover 17 through a hole 34 in the power supply circuit board 33. Visible in FIG. 4 is a strut 174 attached to control circuit board 31 by screw 36 extending through the control circuit board to a bracket 35. The strut 174 is connected to the bracket arm 16 of the sewing machine 10 by screw 175. Removal of screw 38 and screw 175 releases the upper portion of the electronic control arrangement 30. Lower support for the electronic control arrangement 30 is attained by the heat sink arrangement 40. This support may be released by retracting the cone point screw 44, accessible from the bottom opening of the sewing machine 10, from engagement with the inclined surface of the heat sink bracket 42. The electronic control arrangement 30 may then be withdrawn from the sewing machine 10 through its top access opening after removal of the electronic connections thereto. From an inspection of FIGS. 2 and 4 it is evident that by removal of screws 176, 177 attaching the power supply board 33 to support 51 and brace 39 respectively, the power supply board may be separately removed for repair or replacement.

Having set forth the nature of this invention, what is claimed herein is:

1. In a sewing machine having a frame with at least two access openings therein, functional mechanical, electromechanical and electrical components supported within said frame, said functional components including a work feeding system, a needle carrying needle bar, a needle bar gate supporting said needle bar for lateral oscillation and endwise reciprocation, drive means, means connected with said drive means for endwise reciprocating said needle carrying needle bar and for actuating said work feeding system, sewing instrumentalities cooperating with said needle in the formation of stitches, and means for selectively oscillating said needle bar gate and regulating said work feeding system in the formation of decorative and functional stitch patterns; wherein the improvement comprises:

a. a unitary electronic control module removably insertable through an access opening, said module having means attachable to said frame in a position accessible from at least one of said access openings, said module having electronic means thereon for regulating said functional electromechanical and electrical components, said module having a control panel means associated with said module and providing operator access to said electronic means, means for supporting said control panel means on said module in a position to close a portion of at least one of said access openings when said attachable means is attached to said frame; and b. means connecting said electronic control module to said functional electromechanical and electrical components.

2. In a sewing machine as claimed in claim 1, wherein said access openings in said frame include an access opening in the top thereof and in the bottom thereof, said control panel means being positioned to close a portion of said top access opening.

3. In a sewing machine having a frame with access opening at the top and bottom thereof and an auxiliary opening in the front thereof, functional mechanical, electromechanical and electrical components supported within said frame, said functional components including a work feeding system, a needle carrying needle bar, a needle bar gate supporting said needle bar for lateral oscillation and endwise reciprocation, drive means, means connected with said drive means for endwise reciprocating said needle carrying needle bar and for actuating said work feeding system, sewing instrumentalities cooperating with said needle in the formation of stitches, and means for selectively oscillating said needle bar gate and regulating said work feeding system in the formation of decorative and functional stitch patterns; wherein the improvement comprises:

a unitary electronic control module removable insertable through an access opening, said module having means attachable to said frame in a position accessible from said access openings, said module having electronic means and control components thereon for regulating said functional electromechanical and electrical components, said control components being in a position to extend through said auxiliary opening when said attachable means is attached to said frame, a control panel means associated with said module and providing with said control components extending through said auxiliary opening operator access to said electronic means, means supporting said control panel means on said module disposed over a portion of said top access opening when said attachable means is attached to said panel; and, means connecting said electronic control arrangement to said functional electromechanical and electrical components.

* * * * *